United States Patent [19]

Mailliet et al.

[11] 4,403,516

[45] Sep. 13, 1983

[54] FURNACE PROBE

[75] Inventors: Pierre Mailliet, Howald; Victor Kremer, Luxembourg, both of Luxembourg

[73] Assignee: Paul Wurth S.A., Luxembourg

[21] Appl. No.: 340,362

[22] Filed: Jan. 18, 1982

[30] Foreign Application Priority Data

Jan. 23, 1981 [LU] Luxembourg ..... 83087

[51] Int. Cl.[3] ..... G01N 1/26; G01K 13/12

[52] U.S. Cl. ..... 73/863.11; 73/863.31; 73/863.81; 73/864.74; 374/135

[58] Field of Search ..... 73/863.11, 863.31, 863.33, 73/863.81, 864.74; 374/135, 138

[56] References Cited

U.S. PATENT DOCUMENTS 3,085,435 4/1963 Miscoe et al. .
3,130,584 4/1964 Kennedy .
3,240,069 3/1966 Kennedy ..... 73/863.11
3,888,123 6/1975 Kuntziger ..... 73/863.11
4,044,612 8/1977 Powell ..... 73/863.11

FOREIGN PATENT DOCUMENTS 718766 3/1942 Fed. Rep. of Germany .

*Primary Examiner*—S. Clement Swisher
*Attorney, Agent, or Firm*—David S. Fishman

[57] ABSTRACT

Plural gas samples are simultaneously collected and the temperature at each sampling point accurately measured by means of a probe which may be inserted into the furnace charge. The probe is constructed so as to facilitate assembly and repair while insuring against relative motion of the various components thereof as a result of imposed vibrations and thermally induced expansion.

10 Claims, 3 Drawing Figures

FURNACE PROBE

BACKGROUND OF THE INVENTION:

1. Field of the Invention

The present invention relates to the exercise of control over the operation of a furnace and particularly to the collection of gas samples at various locations within a furnace and the measurement of the temperature at each gas sampling point. More specifically, this invention is directed to a sampling probe for insertion into a furnace and especially to a probe for simultaneously taking multiple gas samples and measuring the temperature at each sampling point. Accordingly, the general objects of the present invention are to provide novel and improved methods and apparatus of such character.

2. Description of the Prior Art

In order for a blast furnace, particularly a modern furnace which operates with a comparatively high pressure, to be operated so as to obtain the optimum results, it is essential to monitor conditions within the furnace. The conditions which are desirably monitored include the chemical composition of the gases produced and the temperature profile across the furnace charge. These conditions have previously been sensed through the use of probes which may be inserted into the furnace, both above and into the charge, to collect gas samples and take temperature measurements. The sampling must, of course, be performed at a sufficient number of locations so as to enable the plotting of curves which are commensurate with the furnace operation. It is these curves which provide the furnace operator with the information necessary for control purposes.

There are two types of sampling probes generally known in the prior art. Firstly, there are probes which are fixed in position above the surface of the furnace charge. Secondly, there are probes which are periodically inserted through the wall of the furnace into the mass of the charge. Examples of probes of the latter type may be seen from U.S. Pat. Nos. 3,888,123 and 4,044,612. Those prior art probes which are inserted into the charge itself are typically associated with an external vibrator since a vibrating probe will penetrate the furnace charge with less difficulty.

In order for a furnace probe to perform its intended function, it is essential that the measurements taken with the probe be accurate and reproducible. Unfortunately, such accurate and reproducible measurements have not been insured by the prior art probes, this being particularly true in the case of temperature measurements which were obtained through the use of thermocouples.

Applicants have discovered that the temperature measurement inaccuracies associated with prior art furnace probes may, to a large degree, be attributed to the manner in which the thermocouples were installed in the probes. A typical probe will have a plurality of gas sampling orifices distributed along its length and there will be a thermocouple positioned within the probe and juxtapositioned to each sampling orifice. Due to manufacturing tolerances and assembly errors, and particularly because of the fact that the probe will be subjected to vibration and will undergo thermally induced expansion and subsequent contraction, the thermocouples do not all occupy and/or remain in the same relative position with respect to their associated gas admission orifices. A relative displacement of only a few millimeters is sufficient to produce significant inaccuracies in the temperature measurement. Bearing in mind that the temperature measurements are employed to plot a profile, inaccurate measurements make it impossible to produce a curve which will be representative of the temperature. The inability to accurately produce a temperature profile, in turn, greatly reduces the utility of the probe.

Furnace probes of the type being described must, in addition to providing accurate measurement, be of comparatively modest cost and be characterized by ease of initial assembly and subsequent repair. These requirements are dictated by the demanding environment in which the probes are used, this environment resulting in the need to frequently replace or repair the device. Thus, economic considerations dictate that a furnace gas/temperature probe be easy to assemble and install and that its initial cost be minimized.

SUMMARY OF THE INVENTION

The present invention overcomes the above-discussed and other deficiencies and disadvantages of the prior art and, in so doing, provides a furnace probe which is characterized by the ability to provide accurate and reproducible temperature measurements while being of modest cost. Probes in accordance with the present invention are further characterized by ease of assembly and disassembly.

A probe in accordance with the present invention includes an outer casing surrounding a plurality of gas transmission conduits, there being one conduit associated with each sampling orifice in the casing. An end of each conduit is made integral with a block which, in turn, is permanently affixed to the interior of the casing so as to overlie an aperture therein. A plate, which defines the actual gas admission orifice, is removably attached to each block and cooperates therewith to define a gas sampling chamber which is in communication with the admission orifice. A thermocouple extends into each of these sampling chambers. The thermocouples are mounted so as to be immobilized whereby relative movement thereof with respect to the chamber walls and the gas admission orifice cannot occur. A probe in accordance with the preferred embodiment of the present invention also includes means for achieving internal cooling of the probe, such internal cooling of the probe components helping to insure that the thermocouples will measure only the temperature of the sampled gases.

Also in accordance with a preferred embodiment, the thermocouples are immobilized by means of engaging an integral collar thereon in a circular groove defined by the aforementioned sampling conduit termination block and the plate which is removably affixed thereto.

The present invention also includes, in the preferred embodiment, a pair of conduit supports affixed to each of the sampling conduit termination blocks. These supports are provided with cut-outs through which those conduits which extend past the block toward the probe tip pass. The conduit supports thus fix the position of the sampling conduits while permitting thermally induced expansion thereof.

Also in accordance with a preferred embodiment, the means for achieving internal cooling of the probe comprises a conduit of rectangular cross-section which is coaxial with the probe casing. This rectangular coolant-flow conduit will pass through the conduit supports which are affixed to each sampling conduit termination block.

In order to permit all measurements to be taken simultaneously, the gas admission orifices in accordance with a preferred embodiment of the invention are all provided on the same generatrix of the probe casing, the orifices all being directed in the vertical downward direction while temperature measurements are made and gas samples collected.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE PREFERRED EMBODIMENT

Figure 1:
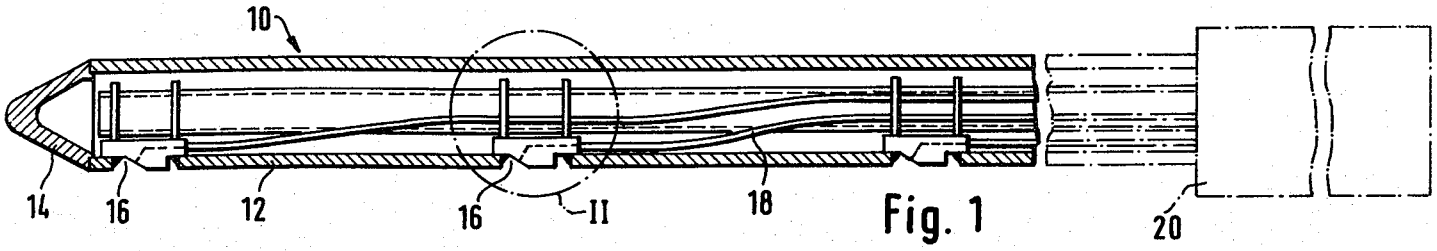
FIG. 1 is a schematic cross-sectional side elevation view of a furnace probe in accordance with the present invention.

With reference now to the drawing, a furnace probe in accordance with the present invention is indicated generally at 10 in FIG. 1. Probe 10 comprises a cylindrical outer metal casing 12 which terminates in a tip 14. The tip 14 is shaped so as to facilitate penetration of the probe into the material with which a furnace is charged. Casing 12 is provided, at regular intervals, with apertures 16 which, in the manner to be described below, enable gas samples to be taken within the furnace and transmitted, via sampling conduits 18, to a receiving device, indicated schematically at 20, which is situated outside of the furnace. The receiving device 20 may include means for chemically analyzing the plural gas samples and possibly also apparatus for providing a visual presentation of the results of the chemical analysis. The receiving device 20 may also include means for processing temperature information collected in the manner to be described below.

As may be seen from FIG. 1, all of the apertures 16 in casing 12 are situated on the same side and same generatrix of the casing. Accordingly, all of the gas samples will be taken at the same level.

Figure 2:
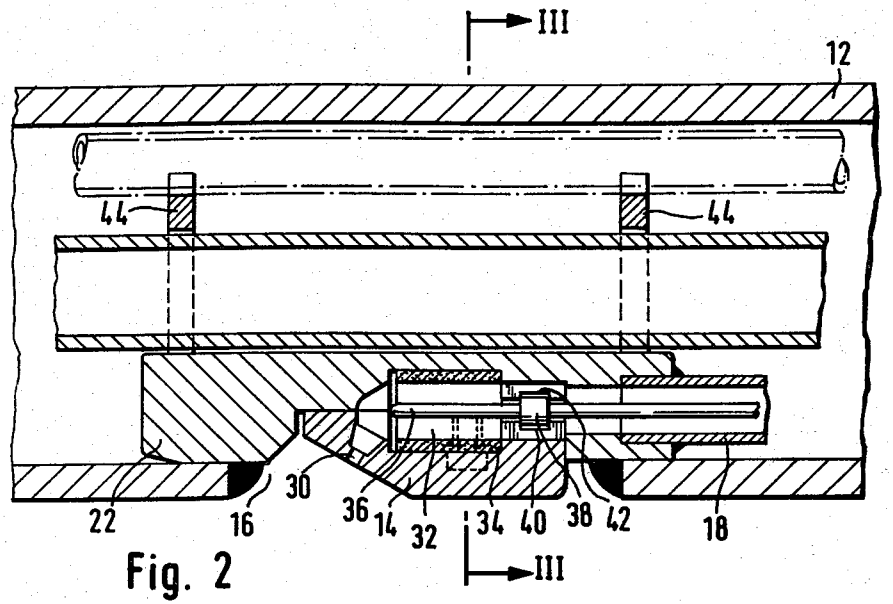
FIG. 2 is an enlarged cross-sectional view of the probe of FIG. 1.

With reference to FIG. 2, a positioning or sampling conduit terminating block 22 is permanently affixed, for example by welding, to the interior of casing 12 over each of the apertures 16. The blocks 22 thus function as hermetic seals which prevent leakage through the apertures 16 to the interior of casing 12. A gas sampling conduit 18 is permanently and hermetically attached, also preferably by welding, to each of the blocks 22. For the purposes to be described below, each of the blocks 22 is provided with a recess in its outwardly facing surface and these recesses communicate, via a passage, with the sampling conduit receiving socket in the block.

Figure 3:
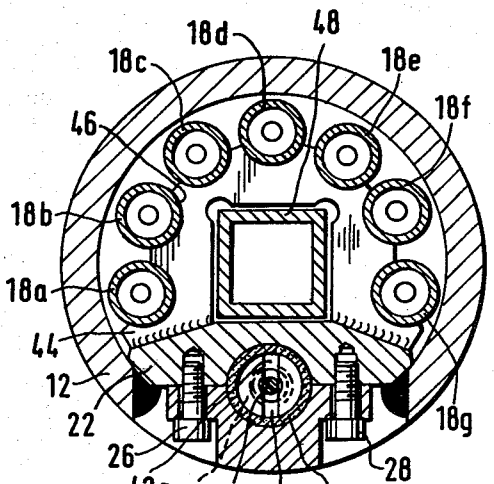
FIG. 3 is a cross-sectional view taken along line III—III of FIG. 2.

A plate 24 is removably attached, for example by means of screws 26 and 28 which may be seen in FIG. 3, to each positioning block 22. The plates 24 are located within the apertures 16 in casing 12 and define the actual gas admission orifices 30 of the probe. The plates 24, like the blocks 22, are provided with a recessed portion and these recessed portions cooperate to define a sampling chamber 32 between the plate 24 and the block 22. The recesses in the block 22 and plate 24 are typically of semi-cylindrical shape and will preferably be provided with a refractory lining as indicated at 34.

Temperature measurements are taken by means of thermocouples 36 which extend into each of the sampling chambers 32. The thermocouples 36 will be inserted via the sampling conduit 18, i.e., the electrical connections to the individual thermocouples will be brought out of the probe through the associated sampling conduits. As previously noted, if accurate and reproducible temperature measurements are to be obtained, the position of each thermocouple in the probe must be well defined and particularly the relative positioning between all of the thermocouples and their associated gas admission orifices must be initially the same and must remain the same during use. Accordingly, each thermocouple 36 is provided with an integral collar 38 and these collars are press fit into a substantially annular groove defined by semi-circular slots 40 and 42 which are respectively provided in the plate 24 and block 22. It is to be noted that the annular groove which receives collar 38 will include portions of increased depth so that gas may flow out of the sampling chamber 32 and into the sampling conduit 18 past the collar 38. In the preferred embodiment, as shown in FIG. 2, the portions of the semi-circular grooves 40 and 42 of increased depth which define the gas flow passage lie in a vertical plane. This arrangement may also be seen from FIG. 3.

The above-described retaining system for thermocouple 36 has the attributes of effectively preventing longitudinal displacement of the temperature sensor and, additionally, is designed to facilitate assembly of the probe since the collar 38, affixed to thermocouple 36, is captured by the groove in plate 24. As noted, plate 24 may be removed from block 22 to thereby free a thermocouple for replacement. The probe assembly procedure will be described below.

In the embodiment represented in the drawing, particularly as depicted in FIG. 3, the probe 10 comprises eight gas sampling conduits 18, 18*a*, 18*b*, 18*c*, 18*d*, 18*e*, 18*f* and 18*g*. There will, similarly, be eight sampling orifice defining devices, each of which is formed by a block 22 and plate 24, and eight thermocouples. The number of sampling conduits 18 may vary according to the diameter of casing 12, the diameter of the furnace with which the probe will be employed and the number of samples which it is desired to take from the furnace over a certain radial distance.

The sampling conduits 18–18*g* are maintained in position inside the casing 12 through the use of cross-pieces 44 which are welded to the sampling conduit termination blocks 22. As shown in FIG. 2, there will preferably be two of these conduit supports 44 attached to each of the blocks 22. Referring to FIG. 3, the cross-pieces 44 are provided with arcuate cut-outs 46 about their periphery. The sampling conduits 18 rest in the cut-outs 46 and thus are captured between the interior wall of casing 12 and the cross-pieces.

Referring again to FIG. 1, the various sampling conduits 18–18*g*, in order to communicate with the apertures 16 in casing 12 which are provided on the same generatrix of the casing, may be twisted in a helicoidal pattern whereby the conduits rotate, between two successive apertures 16, through an angle corresponding to the angle of separation of two adjacent cut-outs 46 in the cross-pieces 44.

A probe in accordance with the preferred embodiment of the present invention is, as has been the prior art practice, provided with a coolant flow circuit. For this purpose a coolant delivery conduit 48 (FIG. 3) will be arranged coaxially with casing 12 and will extend through the cross-piece 44. A liquid coolant will be delivered to the interior of casing 12 via conduit 48, the coolant being discharged from conduit 48 at the tip of the probe and returning to the exterior of the furnace in the free space between the sampling conduits 18–18*g* and the inner wall of casing 12.

In the disclosed embodiment, the coolant supply conduit 48 affords support for the gas sampling conduits 18. Thus, as may be seen from FIG. 3, the coolant supply conduit 48 is of square cross-section and the cross-pieces 44 are similarly provided with square apertures through which the coolant supply conduit passes. This arrangement insures that there will be no relative rotation between the various components of the probe. Obviously, the coolant supply conduit 48 may be of any cross-sectional configuration, triangular or oval for example, but preferably should not be circular.

It is also be to noted that the above-described arrangement for support of the gas sampling conduits 18 is advantageous because of the inability to establish any permanent connection between the gas sampling conduits and the coolant supply conduit. Since these elements have different rates of thermal expansion, permanent connection would result in distortion and possible damage to the probe.

The cut-outs in the cross-pieces 44 will be sized so as to be arcs of circles having a diameter which is greater than that of the gas sampling conduits 18. This facilitates assembly and disassembly of the probe. The mounting of two cross-pieces 44 on each of the blocks 22 insures against wobble or any tendency of the cross-pieces 44 and blocks 22 to assume a skewed position relative to the conduit 48.

The beneficial effect of the support afforded by axial conduit 48 is particularly noticeable during the assembly of probe 10. Since conduit 48 serves as a support for the cross-pieces 44 and for the gas sampling conduits 18, the internal portion of the probe may be assembled around conduit 48 by sliding subassemblies of the various cross-pieces 44 and blocks 22, which have previously been welded together, onto conduit 48. The gas sampling conduits 18 are then properly positioned and the ends thereof welded into the sockets provided therefore in the blocks 22. Next, the external casing 12 will be slid over the thus formed assembly and the blocks 22 will be welded into position over the apertures 16 in the casing. Finally, if not already present in the conduits 18, the thermocouples 36 will be positioned and subsequently captured by means of bolting the plates 24 to the blocks 22.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A probe for taking gas samples and thermal measurements in a furnace comprising:

a tubular external casing, said casing having an axis and being provided with a linear array of spacially displaced apertures in the wall thereof;

a plurality of gas sampling conduits disposed within said casing, said sampling conduits being of different length whereby first ends thereof are located adjacent respective of said casing apertures;

block means positioned within said casing and covering each of said casing apertures, said block means being hermetically sealed to the wall of said casing, said block means each further being hermetically affixed to the end of one of said sampling conduits, said block means further including passages for establishing fluid communication between the interior of the conduit affixed thereto and the outwardly facing side of said block means;

conduit support means positioned within casing, said conduit support means extending generally transversely with respect to the axis of said casing, said sampling conduits being located within said casing by said conduit support means;

plate means detachably connected to each of said block means, said plate means being located in said casing apertures and cooperating with said block means to define a gas sampling chamber in communication with an end of a block means passage, said plate means each further being provided with a gas admission orifice which establishes communication between the exterior of said casing and said sampling chamber;

temperature sensor means positioned within at least some of said gas sampling chambers;

means supporting said temperature sensor means such that movement thereof in a direction parallel to the axis of said casing is prevented; and means for establishing a flow of coolant in said casing.

2. The apparatus of claim 1 wherein said coolant flow establishing means comprises:

an open-ended coolant flow conduit of rectangular cross-sectional area, said coolant flow conduit being coaxial with said casing and extending through apertures in said conduit support means, said apertures in said support means being commensurate in shape with the coolant flow conduit.

3. The apparatus of claim 1 wherein said means for supporting said temperature sensor means comprises:

an annular collar affixed to each of said sensor means; and a locating groove for said collar, said locating groove being defined by cooperating recesses formed in said block means and said plate means.

4. The apparatus of claim 2 wherein said means for supporting said temperature sensor means comprises:

an annular collar affixed to each of said sensor means; and a locating groove for said collar, said locating groove being defined by cooperating recesses formed in said block means and said plate means.

5. The apparatus of claim 4 further comprising:

a refractory lining at least partly covering the wall of said sampling chambers.

6. The apparatus of claim 1 wherein said sampling conduit support means are affixed to said block means.

7. The apparatus of claim 4 wherein said sampling conduit support means are affixed to said block means.

8. The apparatus of claim 4 wherein a pair of spacially displaced support means are affixed to each of said block means.

9. The apparatus of claims 6, 7 and 8 wherein said support means are provided with a plurality of arcuate cut-outs about their periphery and wherein said gas sampling conduits are positioned in said cut-outs and retained in position between said support means and the inner wall of said casing.

10. The apparatus of claim 8 further comprising:

a refractory lining at least partly covering the wall of said sampling chambers.

* * * * *